US009587440B2

(12) United States Patent
Wang et al.

(10) Patent No.: US 9,587,440 B2
(45) Date of Patent: Mar. 7, 2017

(54) DYNAMIC POINT-THE-BIT ROTARY STEERABLE DRILLING TOOL AND MEASURING METHOD THEREOF

(71) Applicant: China University of Petroleum, QingDao (CN)

(72) Inventors: Weiliang Wang, QingDao (CN); Yanfeng Geng, QingDao (CN); Zhidan Yan, QingDao (CN)

(73) Assignee: China University of Petroleum, Qingdao (CN)

( * ) Notice: Subject to any disclaimer, the term of this patent is extended or adjusted under 35 U.S.C. 154(b) by 0 days.

(21) Appl. No.: 14/960,527

(22) Filed: Dec. 7, 2015

(65) Prior Publication Data

US 2016/0281492 A1 Sep. 29, 2016

(30) Foreign Application Priority Data

Mar. 25, 2015 (CN) ..... 104832088A

(51) Int. Cl.
*E21B 7/08* (2006.01)
*E21B 17/02* (2006.01)
(Continued)

(52) U.S. Cl.
CPC ..... *E21B 17/028* (2013.01); *E21B 7/068* (2013.01); *E21B 47/024* (2013.01)

(58) Field of Classification Search
CPC ..... E21B 7/04; E21B 7/06; E21B 7/068
See application file for complete search history.

(56) References Cited

U.S. PATENT DOCUMENTS 6,092,610 A 7/2000 Kosmala et al.
6,837,315 B2 1/2005 Pisoni et al.
(Continued)

FOREIGN PATENT DOCUMENTS

CN 2619041 Y 1/2003
CN 101586440 A 5/2009
(Continued)

*Primary Examiner* — David Andrews
(74) *Attorney, Agent, or Firm* — IPro, PLLC; Na Xu

(57) ABSTRACT

The invention relates to a dynamic point-the-bit rotary steerable drilling tool and a measuring method thereof. The dynamic point-the-bit rotary steerable drilling tool comprises a rotary housing, a stabilized platform assembly, a hollow servo-motor assembly, a drilling fluid passage, an inner eccentric ring, an outer eccentric ring, a drilling bit shaft and a universal joint. The dynamic point-the-bit rotary steerable drilling tool also comprises a stabilized platform communication and power supply system which includes an instrument storehouse fixed at the upper end of the rotary housing, a main circuit board, an auxiliary circuit board mounted on the stabilized platform upper-end cover, an electromagnetic coupler primary-side, an electromagnetic coupler secondary winding and an electromagnetic coupler primary-side mounting plate fixed at the lower end of a coupler. The main circuit board is mounted on the electromagnetic coupler primary-side mounting plate, the electromagnetic coupler secondary winding is connected with the auxiliary circuit board, and the auxiliary circuit board is connected with the attitude sensor mounted on the side wall of the upper end of the stabilized platform body. By the dynamic point-the-bit rotary steerable drilling tool, hollow drilling fluid passage, power supply and signal transmission of the stabilized platform sensor, attitude angle parameter measurement and toolface angle real-time control of the rotary steerable drilling tool are realized.

10 Claims, 8 Drawing Sheets

(51) Int. Cl.
*E21B 7/06* (2006.01)
*E21B 47/024* (2006.01)

(56) References Cited

U.S. PATENT DOCUMENTS

| | | | | |
|---|---|---|---|---|
| 2002/0175003 | A1* | 11/2002 | Pisoni | E21B 7/067 175/74 |
| 2007/0289373 | A1 | 12/2007 | Sugiura | |
| 2013/0319764 | A1* | 12/2013 | Schaaf | E21B 7/06 175/24 |

FOREIGN PATENT DOCUMENTS

| | | | |
|---|---|---|---|
| CN | 102865038 | A | 10/2012 |
| CN | 102913131 | A | 10/2012 |
| CN | 103277047 | A | 5/2013 |
| CN | 104265168 | A | 7/2014 |
| EP | 1258593 | B1 | 4/2002 |

* cited by examiner

DYNAMIC POINT-THE-BIT ROTARY STEERABLE DRILLING TOOL AND MEASURING METHOD THEREOF

FIELD OF THE INVENTION

The invention relates to the technical field of drilling of petroleum and natural gas, in particular relates to a dynamic point-the-bit rotary steerable drilling tool and a measuring method thereof.

BACKGROUND OF THE INVENTION

The rotary steerable drilling tool is an important part for implementing closed-loop steerable drilling and reflects the highest development level of existing rotary steerable drilling tools. The existing rotary steerable drilling tools are classified into push-the-bit and point-the-bit types according to steering ways and into dynamic and static types according to action ways of the bias unit. Compared with other rotary steerable drilling techniques, the dynamic point-the-bit rotary steerable drilling technique can keep the drilling tool at full-rotation states, so as to effectively reduce sliding friction resistance and enhance displacement extension and better hole quality. The dynamic point-the-bit rotary steerable drilling tool worked with LWD (Logging While Drilling) and high-precision downhole closed-loop control system can effectively increase drilling efficiency and rate of penetration, thereby gaining higher drilling economic benefits.

The invention, filed on Feb. 5, 1998 and approved on Jul. 25, 2000 by the name of Actively Controlled Rotary Steerable System and Method for Drilling Wells with the U.S. Pat. No. 6,092,610, discloses a dynamic point-the-bit rotary steerable drilling system. By designing the corresponding measuring and controlling systems, full-rotation drilling of the point-the-bit rotary steerable drilling tools is realized. In this invention, the point-the-bit steerable mechanism based on an offset mandrel can change continuously in structural bending angle from zero degree to the maximum degrees, and the structural bending angle can be kept constant by keeping the eccentric shaft geostationary. However, the drilling fluid passage is designed by means of annulus, at the same time, a signal processing method and a transmission mode of the sensor haven't been detailed, and the annulus fluid passage design method required complicated dynamic seal and reliability is hard to guaranteed.

The invention, filed on Apr. 19, 2002 and approved on Jan. 12, 2004 by the name of Rotary Steerable Drilling Tool with the EU patent No. EP 1258593B1, discloses a dynamic point-the-bit rotary steerable drilling system. In the rotary steerable drilling system, the housing directly drives the drilling bit to rotate and transmits drilling pressure in the meantime. But in this invention, it can be seen that the drilling fluid passage is made of a titanium alloy hose but without showing specific connection methods, power supply and signal transmission methods of internal sensors are not stated and a resolver used for measuring speed requires decoding.

The invention, published on Nov. 25, 2009 by the name of Point-the-bit Rotary Steerable Drilling Tool with Chinese Patent No. CN 101586440A, discloses a point-the-bit rotary steerable drilling tool widely applied in various stratums of different surface mechanical characteristics. The point-the-bit rotary steerable drilling tool is substantially a static point-the-bit rotary steerable drilling system. We can find its defects that a tool housing is fixed, drilling pressure and toque cannot be used to the greatest extent, and the structural bending angle is changed depending on adjustment of bending angle of a mandrel, which adds load to a motor and causes damage of the mandrel borne high-intensity alternating stress for a long time during adjustment of the structural bending angle.

The invention, published on Jan. 9, 2013 by the name of Offsetting Steerable Mechanism Design Method of Dynamic Point-the-bit Rotary Steerable Drilling tool with the Chinese Patent Publication No. CN 102865038A, discloses an offsetting steerable mechanism of a dynamic point-the-bit rotary steerable drilling tool. We can find its defects that the inner and outer eccentric rings of a double-eccentric-ring adjusting mechanism adopted in this invention are driven and adjusted by a servo motor, and the outer eccentric ring is embedded in the stabilized platform, thereby being not compact enough and adding design difficulty to a power supply mechanism of the stabilized platform; a conductive slip ring adopted in this invention supplies power for a power device but it will go wrong in case of violent vibration during drilling; absence of the pressure tubing in the drilling fluid passage requires dynamic seal in the positions of the coupler and the offsetting mechanism, which is substantially unreliable.

The invention, published on Feb. 6, 2013 by the name of Dynamic Point-the-bit Rotary Steerable Drilling Tool with the Chinese patent publication No. CN 102913131A, discloses a dynamic point-the-bit rotary steerable drilling tool and a control method thereof. But it still has its defects that the offsetting mechanism is driven by a hydraulic piston and is not compact enough, the axial displacement of the drilling bit shaft cannot be compensated when the offsetting mechanism is located in the maximum bending angle, and absence of the pressure tubing in the drilling fluid passage requires dynamic seal in the positions of the coupler and the offsetting mechanism, which is substantially unreliable; only the control method is included in this invention but specific mounting methods of the sensor are not mentioned; a conductive slip ring adopted in this invention supplies power for a power device but it is unreliable in case of violent vibration during drilling.

The invention, published on Sept. 4, 2013 by the name of Single-shaft Stabilized Platform Device Used for Rotary Steerable Drilling Tool and its Stabilizing Method with Chinese Patent No. CN 103277047A, discloses a single-shaft stabilized platform device and a stabilizing method thereof The single-shaft stabilized platform device is substantially a stabilized platform device used for a dynamic push-the-bit rotary steerable drilling system. However, it has its defects that a double-torque motor used for controlling the stabilized platform is complicated in structure; a force control method used in this invention is easy to cause speed fluctuation of the stabilized platform; working frequency of a non-contact electromagnetic coupler and distance between the primary side and the auxiliary side during mounting are not elaborated in its specification; power is supplied by a storage battery which is poor in durability and has limited operating time; signal transmission of the stabilized platform sensors depends on a non-contact high-frequency coupling transformer, signal modulation and demodulation are complicated.

SUMMARY OF THE INVENTION

The invention aims to provide a dynamic point-the-bit rotary steerable drilling tool and a measuring method thereof. Via the drilling tool and its measuring method, hollow drilling fluid passage, sensor power supply and signal transmission and toolface angle real-time control of the stabilized platform are realized.

The technical scheme of the invention includes that a dynamic point-the-bit rotary steerable drilling tool comprises a rotary housing, a stabilized platform assembly, a hollow servo-motor assembly, a drilling fluid passage, an inner eccentric ring, an outer eccentric ring, a drilling bit shaft and a universal joint. The stabilized platform assembly comprises a stabilized platform body mounted in the rotary housing and a stabilized platform upper-end cover connected with the stabilized platform body, a stabilized platform upper bearing is fixed between the stabilized platform body and the stabilized platform upper-end cover, the upper end of the stabilized platform upper-end cover is connected with a gear box of the hollow servo-motor assembly through a coupler, and the lower end of the stabilized platform body is connected with the outer eccentric ring. The drilling tool also comprises a stabilized platform communication and power supply system, the stabilized platform communication and power supply system incorporates an instrument storehouse fixed at the upper end of the rotary housing, a main circuit board, an auxiliary circuit board mounted on the stabilized platform upper-end cover, an electromagnetic coupler primary-side, an electromagnetic coupler secondary winding and an electromagnetic coupler primary-side mounting plate fixed at the lower end of the coupler. The main circuit board is mounted on the electromagnetic coupler primary-side mounting plate, the electromagnetic coupler secondary winding is connected with the auxiliary circuit board, and the auxiliary circuit board is connected with an attitude sensor mounted on the side wall of the upper end of the stabilized platform body; the electromagnetic coupler primary-side is mounted relative to the electromagnetic coupler secondary winding with an air layer reserved therebetween; the electromagnetic coupler primary-side is static relative to the rotary housing, and the electromagnetic coupler secondary winding is static relative to the stabilized platform body.

Preferably, the rotary housing of the drilling tool is a hollow annulus with necks used for mounting the universal joint at the lower end. The inner surface of the rotary housing is provided with a rotary housing wire slot between the necks from the top end to the lower end, the rotary housing wire slot is used for guiding wires and as a limit slot during extending and mounting of an antenna.

Preferably in the drilling tool, the wall thickness of the upper end and the lowermost end of the stabilized platform body is larger than that of the middle lower portion, the side wall of the upper end of the stabilized platform body is provided with an elongated mounting groove, and the attitude sensor is mounted in the elongated mounting groove.

Furthermore, an MEMS rate gyroscope, an accelerometer and a fluxgate or north gyro sensor all connected with a power rectifier arranged on the auxiliary circuit board are mounted in the attitude sensor.

Preferably, the drilling fluid passage in the drilling tool is comprised of an instrument storehouse, a pressure tubing fixing plate connected with the inner cylindrical surface of the lower end of the instrument storehouse, a pressure tubing, a hose and a drilling bit shaft, the upper end of the pressure tubing is fixed on the pressure tubing fixing plate, the lower end of the pressure tubing is fixed on the stabilized platform upper-end cover via a pressure tubing bearing, and space is reserved between the pressure tubing and the stabilized platform body as well as the stabilized platform upper-end cover and the hollow servo-motor assembly; the upper end of the hose is in threaded connection with the lower end of the pressure tubing, and the lower end of the hose is in threaded connection with the upper end of the drilling bit shaft.

Furthermore, the hollow servo-motor assembly in the drilling tool comprises a hollow servo-motor body, a hollow magnetic grid speed encoder used for measuring revolving speed of a motor shaft relative to a motor housing, and a hollow gear box used for reducing motor speed and amplifying output torque, wherein the hollow magnetic grid speed encoder is connected with the hollow servo-motor body. The motor shaft of the hollow servo-motor body is connected with the hollow magnetic grid speed encoder and the input end of the hollow gear box respectively, and the output end of the hollow gear box is connected with the coupler.

Further, the main circuit board of the drilling tool is a circular circuit board and is mounted on the electromagnetic coupler primary-side mounting plate via a bearing fixing plate. A main circuit board microcontroller is arranged on the main circuit board together with a power inverter, a voltage regulator, a radio transceiver and a CAN bus driver all connected with the main circuit board microcontroller; the voltage regulator is connected with the main circuit board microcontroller, the radio transceiver and the CAN bus driver. The voltage regulator and the power inverter are connected with a power source management module in the instrument storehouse respectively, an antenna of the radio transceiver stretches over an antenna of a radio transceiver on the auxiliary circuit board via the rotary housing wire slot arranged in the rotary housing, and the CAN bus driver is connected with the CAN bus driver arranged in the instrument storehouse via a CAN bus. The power inverter incorporates an H-bridge circuit and a compensation capacitor, the main circuit board microcontroller controls switch frequency of the H-bridge circuit, inverses direct current supplied by the power management module in the instrument storehouse into alternating current and transmits power to the auxiliary circuit board via the electromagnetic coupler.

Further, the auxiliary circuit board of the drilling tool is provided with an auxiliary circuit board microcontroller, a power rectifier, a radio transceiver and an AD converter, the power rectifier, the radio transceiver and the AD converter are connected with the auxiliary circuit board microcontroller respectively. The power rectifier is connected with the power inverter on the main circuit board via the electromagnetic coupler, the radio transceiver is communicated with the radio transceiver on the main circuit board wirelessly, and the power rectifier and the AD converter are connected with the attitude sensor arranged on the side wall of the upper end of the stabilized platform body.

Further, the instrument storehouse of the drilling tool is an annular cavity, an instrument-bin backup battery, a voltage regulator, an instrument-bin main controller and an MEMS rate gyroscope are mounted in the cavity of the instrument storehouse as well as a motor driver, an AD converter, a CAN bus driver and an instrument-bin power management module all connected with the main controller respectively, the voltage regulator is connected with the instrument-bin power management module, the MEMS rate gyroscope is connected with the AD converter, the motor driver is connected with the hollow servo-motor, the CAN bus driver and the power management module are connected with the main circuit board, and the power management module is connected with the instrument-bin backup battery and a mud motor.

Preferably, in the drilling tool, the inner eccentric ring is disposed in the outer eccentric ring, the inner eccentric ring is connected with the upper end of the drilling bit shaft via an inner eccentric ring bearing, the near lower end of the drilling bit shaft is connected with the universal joint, and the lower end of the drilling bit shaft is connected with a drilling bit. The central axes of outer eccentric ring hollow body and inner eccentric ring hollow body form certain angles with eccentric rings respectively. The outer eccentric ring is a hollow cylinder with an eccentric hole, and the end of the outer eccentric ring connected with the stabilized platform body is provided with a bearing mounting groove. The drilling bit shaft is a hollow cone, the diameter of the lower end of the drilling bit shaft is larger than that of the upper end, the outer cylindrical surface of the inner eccentric ring is provided with six convex arced necks with screw holes, the inner cylindrical surface of the outer eccentric ring is provided with six concave arced necks same in diameter, and the convex arced necks are matched with the concave arced necks. The bottom ends of the concave arced necks are provided with six screws with threads, and the bottom surface of the inner eccentric hole of the outer eccentric ring is provided with eight screw holes used for connecting the stabilized platform body. The inner eccentric ring and the outer eccentric ring are fastened through screws.

Preferably, in the drilling tool, the universal joint comprises a universal joint upper support plate, a universal joint lower support plate and a steel ball, a half of the steel ball is arranged in a slide formed by the universal joint upper support plate and the universal joint lower support plate, and the other half of the steel ball is embedded in a spherical groove in the outer surface of the drilling bit shaft. A corrugated pipe seal preventing drilling fluid from entering the universal joint is arranged between the universal joint lower support plate and the drilling bit shaft.

Further, in the drilling tool, the lower end of the coupler is provided with a cone used for fixing an inner bearing ring between the electromagnetic coupler primary-side mounting plate and the output shaft of the stabilized platform upper-end cover.

Further, the drilling tool also comprises an inner feedback control loop, an outer feedback control loop and a feedforward control loop. The inner feedback control loop is a stabilized platform assembly absolute speed control loop which adjusts motor speed via an absolute speed controller to control absolute speed of the stabilized platform assembly. The outer feedback control loop is a toolface angle control loop which adjusts absolute speed set values of the inner feedback control loop by a toolface angle controller so as to change toolface angle of the rotary steerable drilling tool. The controller of the feedforward control loop outputs compensation values by measured values of the MEMS rate gyroscope, and the compensation values are used for compensating absolute speed fluctuation of the stabilized platform assembly caused by changes of revolving speed of the rotary housing.

The invention also provides a toolface angle measure-control method. By adopting the dynamic point-the-bit rotary steerable drilling tool, the toolface angle measure-control method can adjust toolface parameters of the dynamic point-the-bit rotary steerable drilling tool. Toolface angle and absolute speed of the stabilized platform can be measured via the attitude sensor mounted on the stabilized platform and can be controlled via the inner feedback control loop, the outer feedback control loop and the feedforward control loop. The measure-control method includes steps that the toolface angle controller gives absolute speed set value $n_4$ of the absolute speed controller according to difference between the toolface angle set value and the toolface angle measured value; the absolute speed controller gives motor speed $n_6$ according to difference between the absolute speed set value $n_4$ and the absolute speed $\Delta n$ of the stabilized platform assembly; the feedforward controller outputs a motor speed compensation value $n_5$ according to revolving speed $n_2$ of the rotary housing, the motor driver set value $n_7$ is obtained by compensation value $n_5$ plus the motor speed $n_6$.

The invention also provides a control method of operating drilling tool in different drilling modes. The control method includes that when the rotary steerable drilling tool works in the directional drilling mode, the main controller in the instrument storehouse gives a fixed toolface angle set value and the toolface angle is kept stable by a toolface angle controller; when the rotary steerable drilling tool works in the angle holding drilling mode, the main controller in the instrument storehouse can control the toolface angle set value continuous changes from 0 to 360 degrees, and the toolface angle controller controls the stabilized platform to continuously rotate relative to the ground, and angle holding drilling of the drilling tool is realized.

The invention has the advantages that:

(1) The invention designs a stabilized platform communication and power supply system. The stabilized platform communication and power supply system uses a power management module, a voltage regulator and an electromagnetic coupler to supply power for the main circuit board, the auxiliary circuit board and the attitude sensor, and the power management module is connected with the mud generator and the backup battery. As compared with conventional conductive slip rings, the stabilized platform communication and power supply system does not need mechanical friction for power and signal transmission, thereby being more reliable in operation and stable in power supply.

(2) The main circuit board of the stabilized platform communication and power supply system and the main controller in the instrument storehouse communicate via CAN bus, CAN bus communication allows the main controller to communicate with the main circuit board, LWD and a downhole pulse generator in groups, and communication rate can reach the maximum of 1 Mbps.

(3) The main circuit board and the auxiliary circuit board of the stabilized platform communicate with each other via radio frequency, the microcontroller of the auxiliary circuit board re-encodes parameters like absolute speed, inclination, azimuth, gravity toolface angle and magnetic toolface angle which are measured by the rate gyroscope, the accelerometer and the fluxgate or the north gyroscope respectively and then transmits to the radio transceiver of the main circuit board, which realizes contactless communication.

(4) Borehole oil drilling revolving speed is usually measured by a resolver, what the resolver outputs are sine wave signals which can only be decoded by a decoder to acquire square signal convenient for a motor controller. The magnetic grid speed encoder measures revolving speed of the hollow servo-motor, precision of the magnetic grid encoder is up to 10,000 PPR, and the magnetic grid speed encoder can directly output square signals without decoding and also reliably work in the complicated borehole environment.

(5) The attitude sensor comprises an MEMS rate gyroscope, the accelerometer and the fluxgate or the north gyroscope. The MEMS rate gyroscope uses a special gyroscope chip for high-temperature drilling, its measuring range up to 20,000 degrees per second, and the sensitive axis of the gyroscope is kept parallel to the axis of the rotary housing.

(6) The instrument storehouse, the pressure tubing fixing plate connected with the inner cylindrical surface of the lower end of the instrument storehouse, the pressure tubing, the high-temperature and high-pressure resistant hose or a steel bend pipe and the drilling bit shaft constitute the drilling fluid passage. Compared with a conventional annulus drilling fluid circulation method, the drilling fluid passage has no need of dynamic seal, and drilling fluid is always flowing in the drilling fluid passage, which can lower requirement for seal of electronic devices.

(7) The bias adjusting mechanism is a replaceable manual six-stage adjusting mechanism, which can change the structural bending angle of the rotary steerable drilling tool through different combinations of the inner and outer eccentric rings. The axial distance shortened caused by radial bending of the hose can be compensated by replacing different outer eccentric rings. The bias adjusting mechanism is simple, feasible, compact in structure and needless of a motor mounting and power supply mechanism.

(8) The MEMS rate gyroscope is mounted in the instrument storehouse, the invention designs a toolface angle sensor mounting method and a toolface angle control method based on the MEMS rate gyroscope in the instrument storehouse and the attitude sensor of the stabilized platform. The feedforward control loop in the control method outputs a motor revolving speed compensation value by means of measuring values of the MEMS rate gyroscope in the instrument storehouse for compensating absolute speed fluctuation of the stabilized platform assembly caused by revolving speed changes of the rotary housing.

(9) The rotary steerable drilling tool is filled with lubricating oil of certain pressure, in this way, mechanical lubricating and heat dissipation of devices can be ensured. Meanwhile, internal and external drilling fluid differential pressure can be compensated and the thickness of a drilling fluid circulation pipe is decreased.

Figure 1:
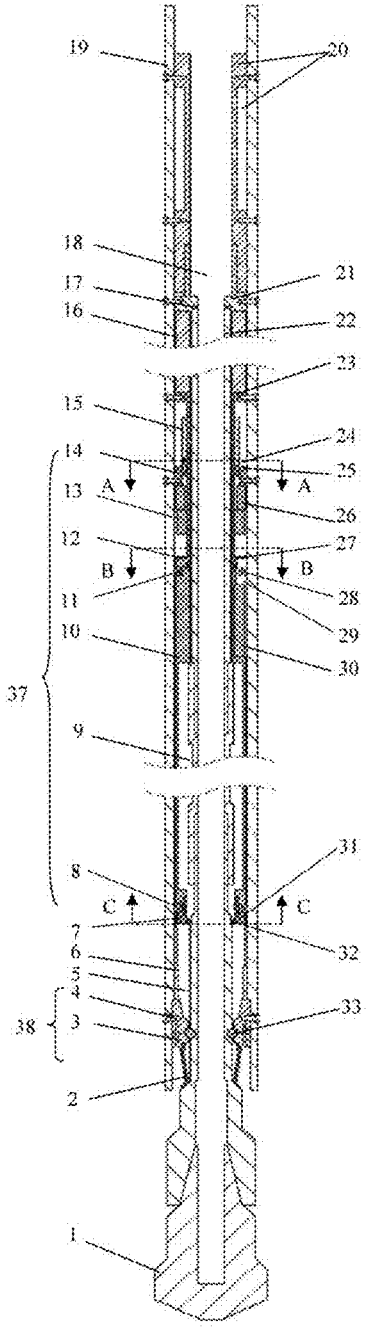
FIG. 1 is a profile schematic illustration showing the embodiments of the invention.

wherein 1 for drilling bit, 2 for corrugated pipe seal, 3 for universal-joint lower support plate, 4 for universal joint upper support plate, 5 for drilling bit shaft, 6 for bearing fixing barrel, 7 for outer eccentric ring, 8 for stabilized platform lower bearing, 9 for hose, 10 for stabilized platform body, 11 for stabilized platform upper bearing, 12 for stabilized platform upper-end cover, 13 for electromagnetic coupler secondary winding, 14 for electromagnetic coupler primary-side mounting plate, 15 for coupler, 16 for hollow servo-motor assembly, 17 for sealing ring, 18 for drilling fluid passage, 19 for rotary housing, 20 for instrument storehouse, 21 for pressure tubing fixing plate, 22 for pressure tubing, 23 for motor fixing plate, 24 for main circuit board, 25 for bearing fixing plate, 26 for electromagnetic coupler primary-side, 27 for auxiliary circuit board, 28 for pressure tubing bearing, 29 for mounting groove, 30 for attitude sensor, 31 for inner eccentric ring, 32 for inner eccentric ring bearing, 33 for steel ball, 34 for rotary housing wire slot, 35 for drilling bit circulating opening, 36 for steel bending pipe, 37 for stabilized platform assembly, 38 for universal joint, 39 for hollow magnetic grid speed encoder, 40 for hollow servo-motor body, 41 for hollow gear box, point A for intersection point of horizontal and vertical lines passing the circular center of the outer eccentric ring, and point B for intersection point of horizontal and vertical lines passing the circular center of the inner eccentric ring.

DESCRIPTION OF THE PREFERRED EMBODIMENTS

Referring now to the drawings for more details.

As shown in FIG. 1, a dynamic point-the-bit rotary steerable drilling tool comprises a rotary housing 19, a stabilized platform assembly 37, a hollow servo-motor assembly 16, a drilling fluid passage 18, an inner eccentric ring 31, an outer eccentric ring 7, a drilling bit shaft 5 and a universal joint 38. The stabilized platform assembly comprises a stabilized platform body 10 mounted in the rotary housing 19 and a stabilized platform upper-end cover 12 connected with the stabilized platform body 10, a stabilized platform upper bearing 11 is fixed between the stabilized platform body 10 and the stabilized platform upper-end cover 12, the upper end of the stabilized platform upper-end cover 12 is connected with the hollow servo-motor assembly 16 via a coupler 15, the absolute speed and the toolface angle of the stabilized platform are controlled by the hollow servo-motor assembly 16, and the lower end of the stabilized platform body 10 is connected with the outer eccentric ring 7.

Figure 3:
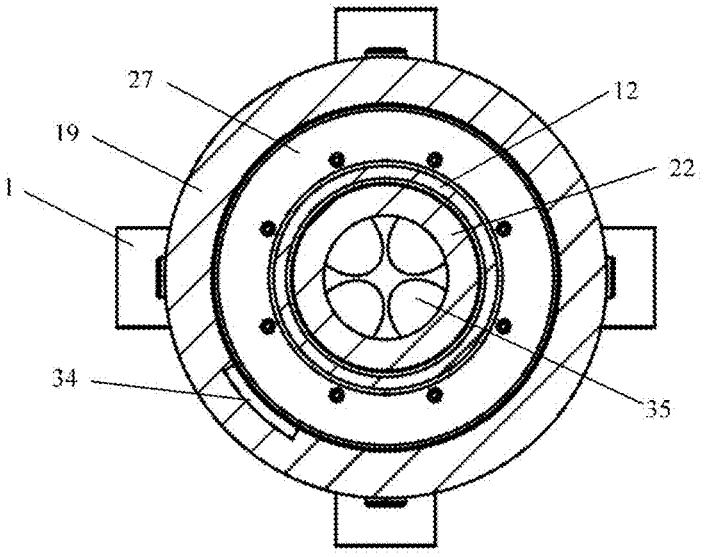
FIG. 3 is a profile schematic illustration showing the B-B position of the auxiliary circuit board of FIG. 1 of the embodiments of the invention.

In this embodiment, FIG. 1 and FIG. 3 show the rotary housing 19 is a hollow annulus with necks used for mounting the universal joint at the lower end, the inner surface of the rotary housing 19 is provided with a rotary housing wire slot 34 between the necks from the top end to the lower end, and the rotary housing wire slot 34 is used for guiding wires and as a limit slot during assembly and mounting of an antenna.

In this embodiment, FIG. 1 shows the thickness of the side wall of the upper end of the stabilized platform body 10 is larger than that of the side wall of the middle lower end, the side wall of the upper end of the stabilized platform body 10 is provided with an elongated mounting groove 29, and the attitude sensor 30 is mounted in the elongated mounting groove 29.

In this embodiment, FIG. 1 shows the drilling bit shaft 5 is a hollow cone, the diameter of the lower end of the drilling bit shaft is larger than that of the upper end, the upper end of the drilling bit shaft 5 is connected with an inner eccentric ring bearing 32, and the near lower end is connected with the universal joint 38. The lower end of the drilling bit shaft is connected with a drilling bit 1, and the drilling bit shaft 5 can be directly connected with a drill collar.

In this embodiment, FIG. 1 shows the drilling fluid passage 18 is comprised of an instrument storehouse 20, a pressure tubing fixing plate 21 connected with the inner cylindrical surface of the lower end of the instrument storehouse 20, a pressure tubing 22, a hose 9 and a drilling bit shaft 5, the upper end of the pressure tubing 22 is fixed on the pressure tubing fixing plate, the lower end of the pressure tubing 22 is fixed on the stabilized platform upper-end cover 12 via a pressure tubing bearing 28, and space is reserved between the pressure tubing 22 and the stabilized platform body 10 as well as the stabilized platform upper-end cover 12 and the hollow servo-motor assembly 16; the upper end of the hose 9 is in threaded connection with the lower end of the pressure tubing 22, and the lower end of the hose 9 is in threaded connection with the upper end of the drilling bit shaft 5. The inner cylindrical surface of the lower end of the instrument storehouse 20 and the outer cylindrical surface of the hollow cylinder stretching from the upper end of the pressure tubing fixing plate 21 are precisely machined to form mechanical seal for preventing drilling fluid from leaking to the rotary housing wire slot 34. When the included angle and the structural bending angle are formed between the axis of the drilling bit shaft and the axis of the rotary housing by the bias adjusting mechanism, the hose 9 can compensate axial disalignment caused by the included angle by its deformation.

In this embodiment, FIG. 1 shows the universal joint 38 comprises a universal joint upper support plate 4, a universal joint lower support plate 3 and a steel ball 33. A half of the steel ball 33 is arranged in a slide formed by the universal joint upper support plate 4 and the universal joint lower support plate 3, and the other half of the steel ball 33 is embedded in a spherical groove in the outer surface of the drilling bit shaft 5. During drilling of the rotary steerable drilling tool, the rotary housing 19 transmits drilling torque to the drilling bit shaft 5 via the steel ball 33; a corrugated pipe seal 2 that can prevent drilling fluid from entering the universal joint is arranged between the universal joint lower support plate 3 and the drilling bit shaft 5.

Figure 2:
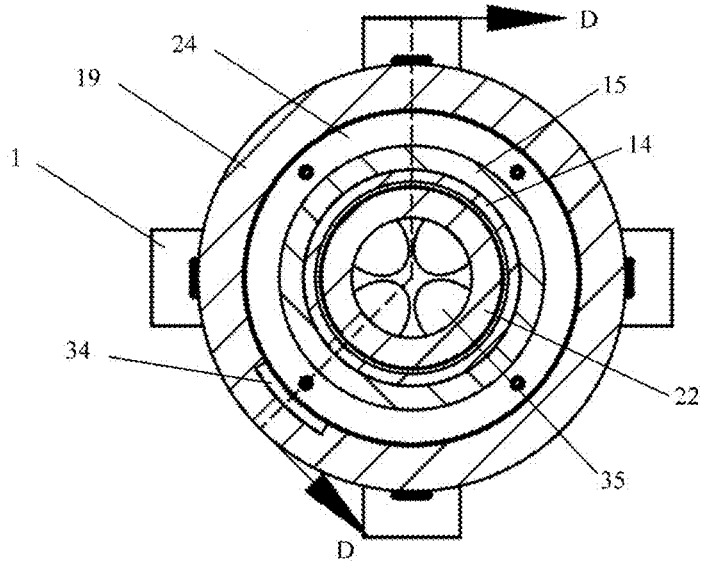
FIG. 2 is a profile schematic illustration showing the A-A position of the main circuit board of FIG. 1 of the embodiments of the invention.

In this embodiment, FIG. 2 shows the main circuit board 24 is a circular circuit board mounted on the electromagnetic coupler primary-side mounting plate 14 via the bearing fixing plate 25.

In this embodiment, FIG. 3 shows the auxiliary circuit board 27 is mounted on the stabilized platform upper-end cover 12.

Figure 4:
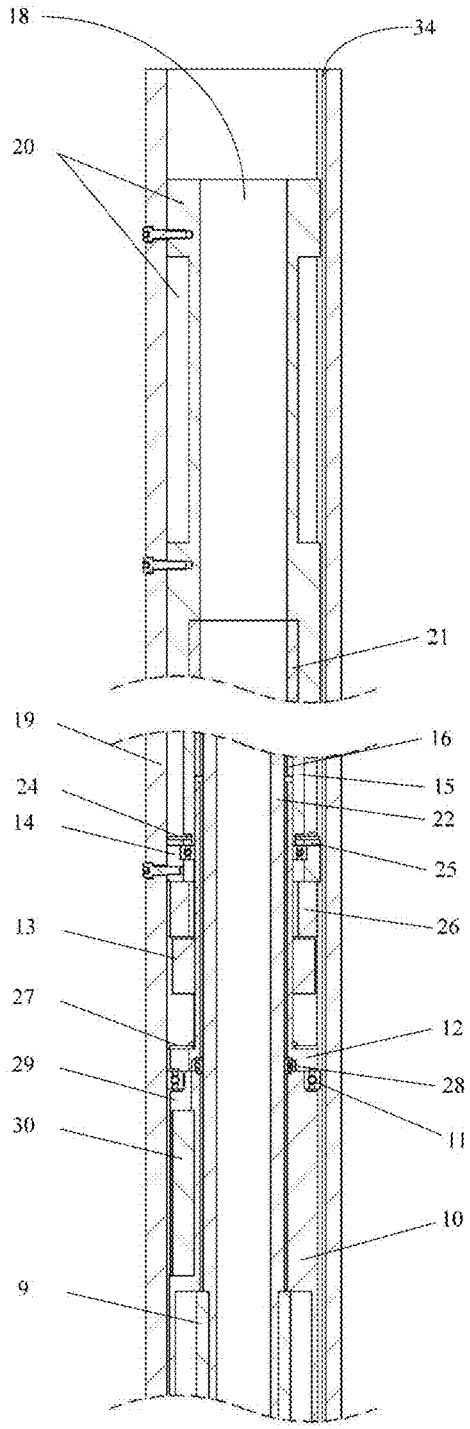
FIG. 4 is a profile schematic illustration showing the D-D position of the stabilized platform communication and power supply system of FIG. 1 of the embodiments of the invention.

In this embodiment, FIG. 4 shows the drilling tool also comprises a stabilized platform communication and power supply system. The stabilized platform communication and power supply system incorporates an instrument storehouse 20 fixed at the upper end of the rotary housing 19, a main circuit board 24, an auxiliary circuit board 27, an electromagnetic coupler primary-side 26, an electromagnetic coupler secondary winding 13 and an electromagnetic coupler primary-side mounting plate 14 fixed at the lower end of a coupler 15. The main circuit board 24 is mounted on the electromagnetic coupler primary-side mounting plate 14, the electromagnetic coupler secondary winding 13 is connected with the auxiliary circuit board 27, and the auxiliary circuit board 27 is connected with an attitude sensor 30 mounted on the side wall of the stabilized platform body 10 upper end. The electromagnetic coupler primary-side 26 is mounted relative to the electromagnetic coupler secondary winding 13 with an air layer reserved therebetween, the air layer is 1.5 mm thick and capable of guaranteeing the relative rotation of the electromagnetic coupler primary-side 26 and the electromagnetic coupler secondary winding 13, the electromagnetic coupler primary-side 26 is static relative to the rotary housing 19, and the electromagnetic coupler secondary winding 13 is static relative to the stabilized platform body 10.

In this embodiment, working frequency of the electromagnetic coupler is around resonance frequency, generally below 100 KHz. Compensation capacitors on the main circuit board 24 and the auxiliary circuit board 27 can improve power stability. The radio transceiver designed on the main circuit board 24 is 433 MHz at carrier frequency and 500 Kbps at the maximum communication rate, and another radio transceiver same as the aforementioned radio transceiver of the main circuit board 24 is designed on the auxiliary circuit board 27 and can bidirectionally communicate with the other one. The microcontroller of the main circuit board can re-encode stabilized platform data acquired by the radio transceiver and transmit data to the main controller in the instrument storehouse 20 via the CAN bus. Meanwhile, the main controller issues control commands to the microcontroller of the main circuit board via the CAN bus. The maximum communication rate of the CAN bus is 1 Mbps. The microcontroller of the auxiliary circuit board samples measuring signals of the MEMS rate gyroscope, the accelerometer and the fluxgate or the north gyro sensor in the attitude sensor 30 by means of 16-bit AD converter. Measuring values are filtered and processed to calculate inclination, azimuth and toolface angle and re-encoded to be transmitted to the main circuit board 24 via the radio transceiver.

In this embodiment, as shown in FIG. 4, the electromagnetic coupler housing and the rotary housing 19 constitute a relatively closed metal cavity which is adverse to radio signal transmission. In this embodiment, the radio transceiver on the main circuit board 24 extends its antenna to the radio transceiver antenna on the auxiliary circuit board 27 through the rotary housing wire slot 34 in the rotary housing 19, communication quality is thereby improved, and a power supply and signal outgoing line of the attitude sensor 30 is connected with a wire slot in the back of the auxiliary circuit board 27 via the mounting groove 29.

Figure 5:
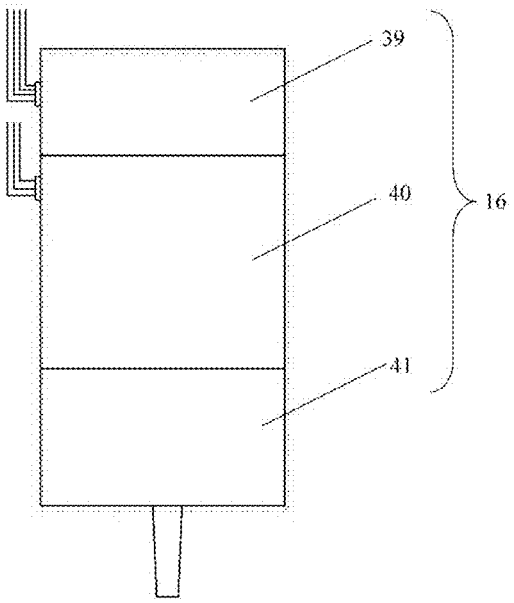
FIG. 5 is a schematic illustration showing the hollow servo-motor assembly of FIG. 1 of the embodiments of the invention.

In this embodiment, FIG. 5 shows the hollow servo-motor assembly 16 is connected with a hollow magnetic grid speed encoder 39 used for measuring revolving speed of the motor shaft relative to the motor housing and a hollow gear box 41 used for lowering revolving speed of the motor and amplifying output torque, the motor shaft of the hollow servo-motor body 40 is connected with the hollow magnetic grid speed encoder 39 and the input end of the hollow gear box 41 respectively, the output end of the hollow gear box 41 is connected with the coupler 15, and the hollow gear box 41 can be a hollow planetary reducer or other types of reducers.

Figure 6:
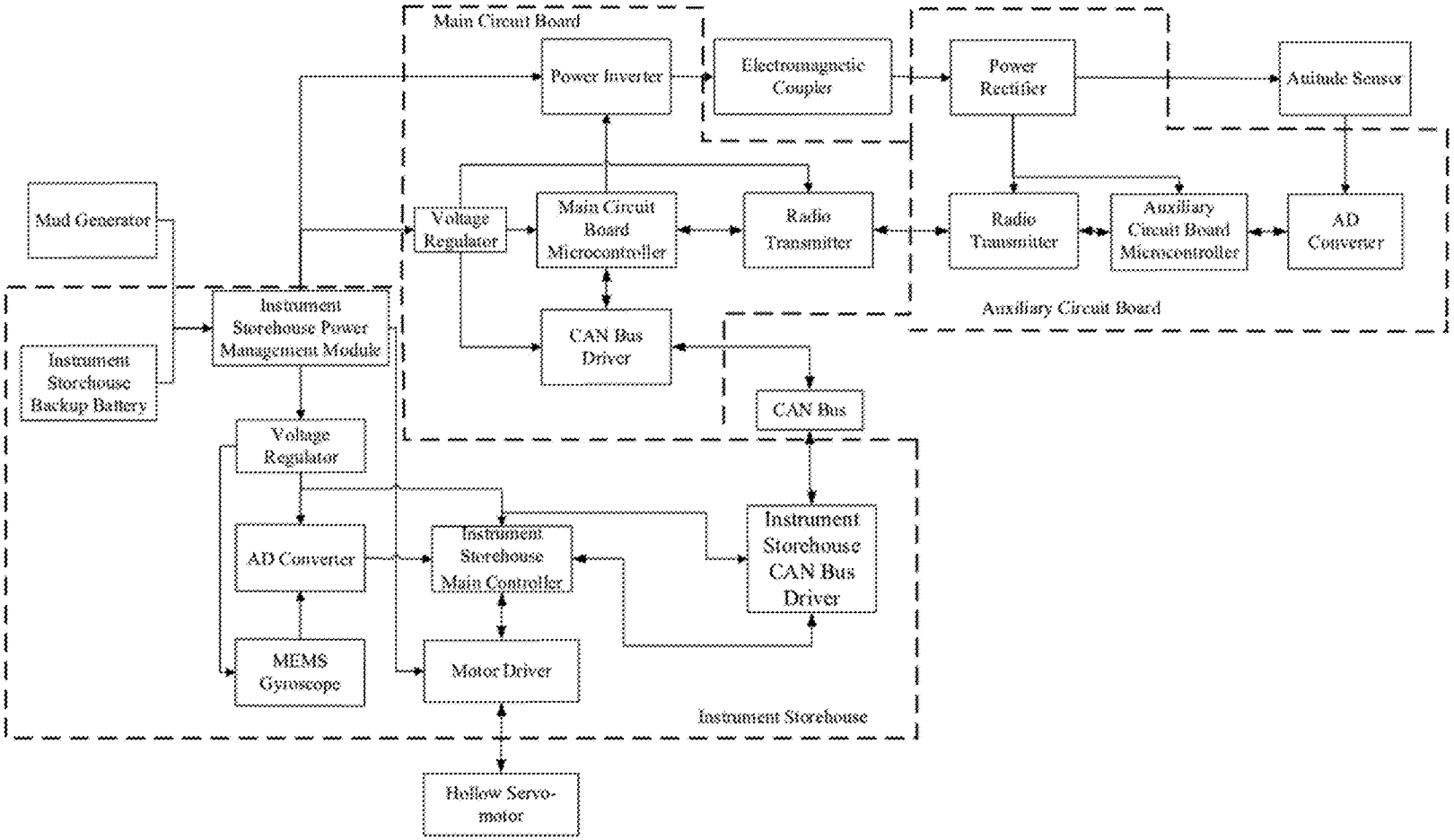
FIG. 6 is a circuit connection diagram of FIG. 1 of the embodiments of the invention.

In this embodiment, FIG. 6 shows the main circuit board 24 is provided with a main circuit board microcontroller, a power inverter, a voltage regulator and a CAN bus driver, wherein the power inverter, the voltage regulator, the radio transceiver and the CAN bus driver are connected with the main circuit board microcontroller respectively. The voltage regulator is connected with the main circuit board microcontroller, the radio transceiver and the CAN bus driver. The voltage regulator and the power inverter are connected with the power management module in the instrument storehouse 20 respectively, the antenna of the radio transceiver stretches over the antenna of the radio transceiver on the auxiliary circuit board 27 via the rotary housing wire slot 34 arranged in the rotary housing 19, and the CAN bus driver is connected with the CAN bus driver arranged in the instrument storehouse via a CAN bus. The power inverter incorporates an H-bridge circuit and a compensation capacitor, the main circuit board microcontroller controls switch frequency of the H-bridge circuit, inverses direct current supplied by the power management module in the instrument storehouse 20 into alternating current and transmits power to the auxiliary circuit board 27 via the electromagnetic coupler.

In this embodiment, FIG. 6 shows the auxiliary circuit board 27 is provided with an auxiliary circuit board microcontroller, a power rectifier, a radio transceiver and an AD converter, wherein the power rectifier, the radio transceiver and the AD converter are connected with the auxiliary circuit board microcontroller respectively. The power rectifier is connected with the power inverter on the main circuit board 24 via the electromagnetic coupler, the radio transceiver is communicated with the radio transceiver on the main circuit board 24 wirelessly, and the power rectifier and the AD converter are connected with the attitude sensor 30 arranged on the side wall of the upper end of the stabilized platform body 10. The MEMS rate gyroscope, the accelerometer and the fluxgate or the north gyro sensor are arranged in the attitude sensor 30 and powered by the auxiliary circuit board 27.

In this embodiment, FIG. 6 shows a backup battery, a voltage regulator, a main controller, an MEMS rate gyroscope as well as a motor driver, an AD converter, a CAN bus driver and a power management module connected with the main controller are mounted in the cavity of the instrument storehouse 20. The voltage regulator is connected with the power management module, the MEMS rate gyroscope is connected with the AD converter, the motor driver is connected with the hollow servo-motor assembly 16, the CAN bus driver and the power management module are connected with the main circuit board 24, and the power management module is connected with the backup battery and the mud generator.

Figure 7:
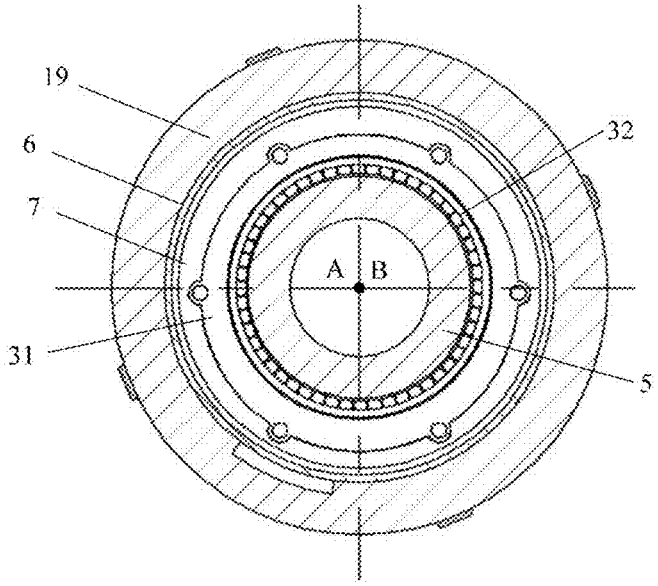
FIG. 7 is a profile schematic illustration showing the C-C position of the bias adjusting mechanism without bias in FIG. 1 of the embodiments of the invention.
Figure 8:
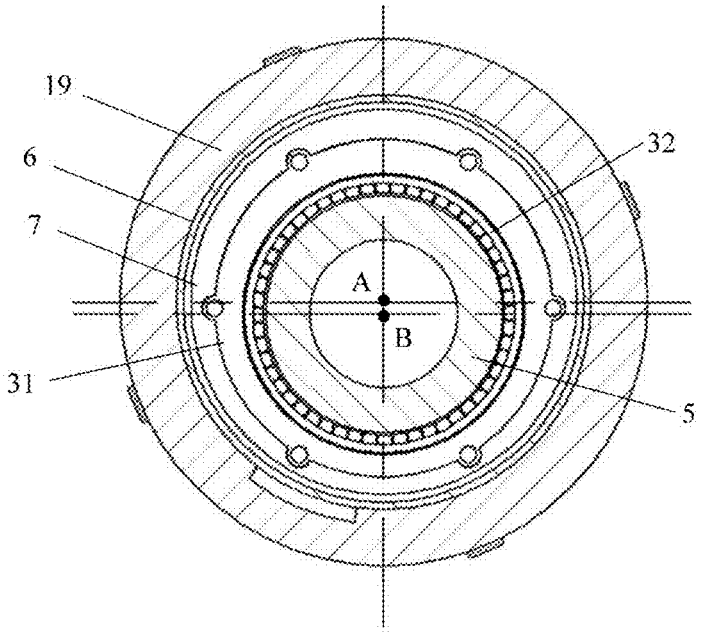
FIG. 8 is a profile schematic illustration showing the C-C position of the bias adjusting mechanism with bias in FIG. 1 of the embodiments of the invention.

In this embodiment, FIGS. 1, 7 and 8 show the inner eccentric ring 31 is disposed in the outer eccentric ring 7, the inner eccentric ring 31 is connected with the drilling bit shaft 5 via an inner eccentric ring bearing 32, and the central axes of outer eccentric ring 7 hollow body and inner eccentric ring 31 hollow body form certain angles with eccentric rings respectively.

In this embodiment, FIG. 7 and FIG. 8 show the outer eccentric ring 7 is a hollow cylinder with an eccentric hole, and the end of the outer eccentric ring connected with the stabilized platform body 10 is provided with a bearing mounting groove. The outer cylindrical surface of the inner eccentric ring 31 is provided with six convex arced necks with screw holes, the inner cylindrical surface of the outer eccentric ring 7 is provided with six concave arced necks same in diameter and the convex arced necks are matched with the concave arced necks. The bottom ends of the concave arced necks are provided with six screws with threads, the bottom surface of the inner eccentric hole of the outer eccentric ring 7 is provided with eight screw holes used for connecting the stabilized platform body 10. The inner eccentric ring 31 and the outer eccentric ring 7 are fastened through screws. As shown in FIG. 7, the point A and the point B coincide, the axis of the drilling bit shaft and the axis of the rotary housing coincide, and the structural bending angle of the rotary steerable drilling tool is zero degree. As shown in FIG. 8, the point A and the point B do not coincide, offset distance is the maximum design offset distance, the structural bending angle of the rotary steerable drilling tool is the maximum design bending angle. When the relative positions of the point A and the point B are located between FIG. 7 and FIG. 8, the structural bending angle of the rotary steerable drilling tool is between zero degree and the maximum design structural bending angle. In the embodiment, the maximum design structural bending angle is 1 degree and can be adjusted in four steps including zero, 0.5, 0.87 and 1 degree through six-step adjustment of the inner eccentric ring by means of adjustment theory of the bias adjusting mechanism.

Figure 9:
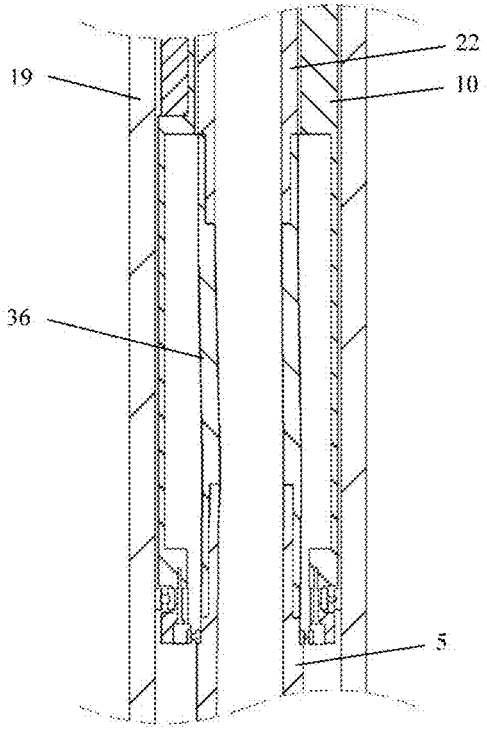
FIG. 9 is a structural schematic illustration of the drilling fluid passage which is a steel bending pipe of the embodiments.

FIG. 9 shows another schematic illustration showing of the drilling fluid passage. In the passage, the hose 9 is replaced with the steel bending pipe 36. The steel bending pipe 36 is a pressure resistant steel pipe with fixed bending angle and threads at two ends and its connecting way is same as that of the hose 9. The replaceable scheme is characterized in that the steel pipe is more resistant to high temperature and can be used for deep-well drilling; the bending angle is fixed, less deformable in drilling and high in reliability; to adjust different structural bending angles needs to replace steel bending pipes of different bending, so this drilling fluid passage is complicated in use.

Figure 10:
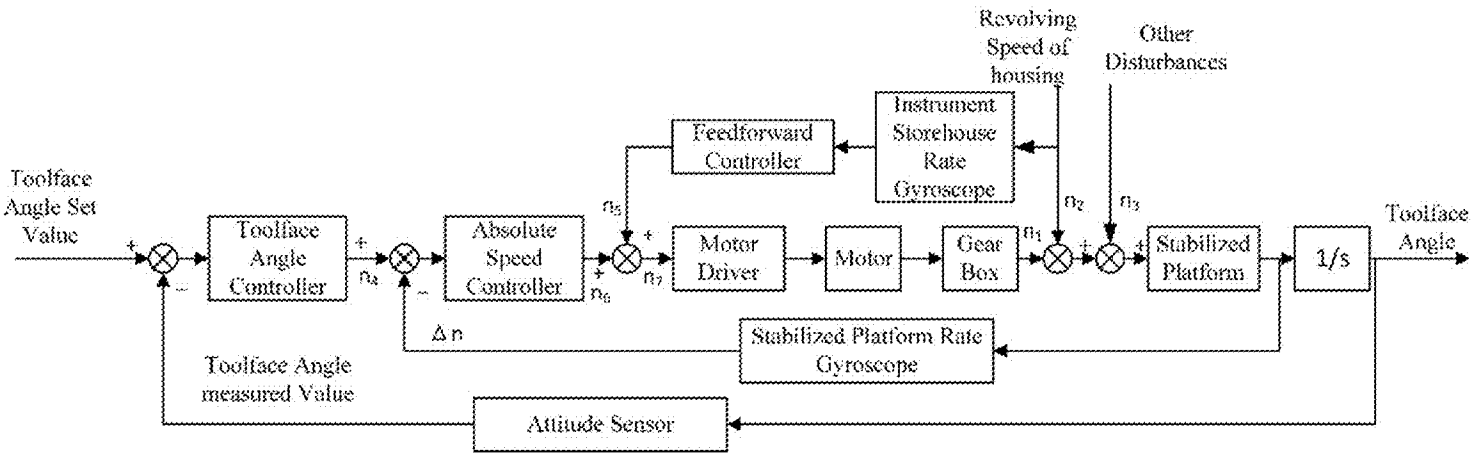
FIG. 10 is a toolface angle control diagram illustration of the embodiments.

In this embodiment, as shown in FIG. 10, the drilling tool also comprises an inner feedback control loop, an outer feedback control loop and a feedforward control loop. The inner feedback control loop is an absolute speed control loop of the stabilized platform assembly 37. The absolute speed controller adjusts motor speed to control absolute speed of the stabilized platform assembly 37. The outer feedback control loop is a toolface angle control loop. The toolface angle controller adjusts absolute speed set value to change toolface angle of the rotary steerable drilling tool. The feedforward controller outputs compensation values of the motor speed by calculating the measured values of the MEMS rate gyroscope in the instrument storehouse 20. The compensation values are used for compensating absolute speed fluctuation of the stabilized platform assembly caused by changes of revolving speed of the rotary housing 19, so as to improve control accuracy of the stabilized platform. The toolface angle controller and the absolute speed controller can be implemented by PID algorithm or other similar algorithms in the main controller of the instrument storehouse 20.

In this embodiment, the rotary steerable drilling tool also comprises a drill collar arranged above the rotary housing 19 so as to improve weight on bit, a mud motor arranged above the rotary housing 19 to change rotary torque of the rotary housing 19, and a mud generator arranged above the rotary housing 19 to supply power for the rotary steerable drilling tool.

In this embodiment, FIG. 10 shows the invention also discloses a toolface angle measure-control method in order to ensure accurate guiding of the rotary steerable drilling tool.

In the measuring method, the absolute speed adjustment theory of the stabilized platform assembly includes setting output revolving speed $n_1$ of the hollow servo-motor assembly 16, absolute speed $n_2$ of the rotary housing, revolving speed $n_3$ caused by other turbulences and the absolute speed $\Delta n=n_1+n_2+n_3$ of the stabilized platform assembly, absolute speed $\Delta n$ is measured by the MEMS rate gyroscope in the attitude sensor 30. $n_3$ is measurable and uncontrollable speed disturbance, the main controller in the instrument storehouse 20 can adjust absolute speed Δn of the stabilized platform assembly via revolving speed $n_1$ of the hollow servo-motor assembly 16.

The measure-control method includes steps that the toolface angle controller gives absolute speed set value $n_4$ of the absolute speed controller according to difference between the toolface angle set value and the toolface angle of the dynamic point-the-bit rotary steerable drilling tool of the attitude sensor 30; the absolute speed controller gives motor speed $n_6$ according to difference between the absolute speed set value $n_4$ and the absolute speed Δn of the stabilized platform assembly; the feedforward controller outputs a motor speed compensation value $n_5$ according to revolving speed $n_2$ of the rotary housing, the motor driver set value $n_7$ is obtained by compensation value $n_5$ plus the motor speed $n_6$.

In this embodiment, the invention provides a control method of operating drilling tool in different drilling modes. The control method includes that when the rotary steerable drilling tool works in the directional drilling mode, the main controller in the instrument storehouse 20 gives a fixed toolface angle set value and the toolface angle is kept stable by a toolface angle controller, at this time, the absolute speed Δn of the stabilized platform assembly is zero, and the stabilized platform assembly 37 is geostationary; when the rotary steerable drilling tool works in the angle holding drilling mode, the main controller in the instrument storehouse 20 can control the toolface angle set value continuous changes from 0 to 360 degrees, and the toolface angle controller controls the stabilized platform to continuously rotate relative to the ground, at this time, the absolute speed Δn of the stabilized platform assembly is not zero, and angle holding drilling of the drilling tool is realized.

The present embodiments are therefore considered as mere description of the invention, all simple transformations and modifications of those skilled in the art should be intended to be embraced in the claims of the invention.

What is claimed is:

1. A dynamic point-the-bit rotary steerable drilling tool, comprising a rotary housing (19), a stabilized platform assembly (37), a hollow servo-motor assembly (16), a drilling fluid passage (18), an inner eccentric ring (31), an outer eccentric ring (7), a drilling bit shaft (5) and a universal joint (38); wherein the stabilized platform assembly (37) comprises a stabilized platform body (10) mounted in the rotary housing (19) and a stabilized platform upper-end cover (12) connected with the stabilized platform body; wherein a stabilized platform upper-bearing (11) is fixed between the stabilized platform body (10) and the stabilized platform upper-end cover (12); wherein an upper end of the stabilized platform upper-end cover (12) is connected with a gear box of the hollow servo-motor assembly (16) through a coupler (15), and a lower end of the stabilized platform body (10) is connected with the outer eccentric ring (7); wherein said dynamic point-the bit rotary steerable drilling tool further comprises a stabilized platform communication and power supply system; wherein said stabilized platform communication and power supply system incorporates an instrument storehouse (20) fixed at an upper end of the rotary housing (19), a main circuit board (24), an auxiliary circuit board (27) mounted on the stabilized platform upper-end cover (12), an electromagnetic coupler primary-side (26), an electromagnetic coupler secondary winding(13) and an electromagnetic coupler primary-side mounting plate (14) fixed at a lower end of the coupler (15); wherein the main circuit board (24) is mounted on the electromagnetic coupler primary-side mounting plate (14); wherein the electromagnetic coupler secondary winding (13) is connected with the auxiliary circuit board (27), and the auxiliary circuit board (27) is connected with an attitude sensor (30) mounted on a side wall of an upper end of the stabilized platform body (10); wherein the electromagnetic coupler primary-side (26) is mounted relative to the electromagnetic coupler secondary winding(13) with an air layer reserved therebetween; wherein the electromagnetic coupler primary-side (26) is static relative to the rotary housing (19), and the electromagnetic coupler secondary winding(13) is static relative to the stabilized platform body (10).

2. The dynamic point-the-bit rotary steerable drilling tool of claim 1, wherein said rotary housing (19) is a hollow annulus with necks used for mounting the universal joint at the lower end; wherein the inner surface of the rotary housing (19) is provided with a rotary housing wire slot (34) between the necks from a top end to a lower end wherein the rotary housing wire slot (34) is used for guiding wires and as a limit slot during assembly and mounting of an antenna; wherein the side wall of the upper end of the stabilized platform body (10) is thicker than a side wall of middle and lower ends and is provided with an elongated mounting groove (29), and the attitude sensor (30) is mounted in the elongated mounting groove (29).

3. The dynamic point-the-bit rotary steerable drilling tool of claim 1, wherein said drilling fluid passage (18) is comprised of an instrument storehouse (20), a pressure tubing fixing plate (21) connected with an inner cylindrical surface of the lower end of the instrument storehouse (20), a pressure tubing (22), a hose (9) and a drilling bit shaft (5); wherein an upper end of the pressure tubing (22) is fixed on the pressure tubing fixing plate, a lower end of the pressure tubing (22) is fixed on the stabilized platform upper-end cover (12) via a pressure tubing bearing (28), and space is reserved between the pressure tubing (22) and the stabilized platform body (10) as well as the stabilized platform upper-end cover (12) and the hollow servo-motor assembly (16); wherein an upper end of the hose (9) is in threaded connection with the lower end of the pressure tubing (22), and a lower end of the hose (9) is in threaded connection with an upper end of the drilling bit shaft (5).

4. The dynamic point-the-bit rotary steerable drilling tool of claim 1, wherein said hollow servo-motor assembly (16) is connected with a hollow magnetic grid speed encoder (39) used for measuring revolving speed of a motor shaft relative to a motor housing and a hollow gear box (41) used for reducing revolving speed of a motor and amplifying output torque; wherein the motor shaft of the hollow servo-motor body (40) is connected with the hollow magnetic grid speed encoder (39) and an input end of the hollow gear box (41), and an output end of the hollow gear box (41) is connected with the coupler (15).

5. The dynamic point-the-bit rotary steerable drilling tool of claim 1, wherein said main circuit board (24) is circular and mounted on the electromagnetic coupler primary-side mounting plate (14) via a bearing fixing plate (25); wherein a main circuit board microcontroller is arranged on the main circuit board (24) together with a power inverter, a voltage regulator, a radio transceiver and a CAN bus driver all connected with the main circuit board microcontroller wherein the voltage regulator is connected with the main circuit board microcontroller, the radio transceiver and the CAN bus driver; wherein the voltage regulator and the power inverter are connected with a power source management module in the instrument storehouse (20) respectively; wherein an antenna of the radio transceiver is configured to stretch over the antenna of the radio transceiver on the auxiliary circuit board (27) via the rotary housing wire slot (34) arranged in the rotary housing (19), and the CAN bus driver is connected with the CAN bus driver arranged in the instrument storehouse (20) via a CAN bus; wherein the power inverter is configured to incorporate an H-bridge circuit and a compensation capacitor; wherein the main circuit board microcontroller is configured to control switch frequency of the H-bridge circuit, and to inverse direct current supplied by the power management module in the instrument storehouse (20) into alternating current and to transmit power to the auxiliary circuit board (27) via the electromagnetic coupler.

6. The dynamic point-the-bit rotary steerable drilling tool of claim 1, wherein said auxiliary circuit board (27) is provided with an auxiliary circuit board microcontroller, a power rectifier, a radio transceiver and an AD converter; wherein the power rectifier, the radio transceiver and the AD converter are connected with the auxiliary circuit board microcontroller respectively; wherein the power rectifier is connected with the power inverter on the main circuit board (24) via the electromagnetic coupler; wherein the radio transceiver is communicated with the radio transceiver on the main circuit board (24) wirelessly, and the power rectifier and the AD converter are connected with the attitude sensor (30) arranged on the side wall of the upper end of the stabilized platform body (10).

7. The dynamic point-the-bit rotary steerable drilling tool of claim 1, wherein said instrument storehouse (20) is an annular cavity; wherein a backup battery, a voltage regulator, a main controller and an MEMS rate gyroscope are mounted in the cavity of the instrument storehouse (20) as well as a motor driving plate, an AD converter, a CAN bus driver and a power management module all connected with the main controller respectively; wherein the voltage regulator is connected with the power management module; wherein the MEMS rate gyroscope is connected with the AD converter; wherein the motor driving plate is connected with the hollow servo-motor assembly (16); wherein the CAN bus driver and the power management module are connected with the main circuit board (24), and the power management module is connected with the backup battery and a mud motor.

8. The dynamic point-the-bit rotary steerable drilling tool of claim 1, wherein said inner eccentric ring (31) is disposed in the outer eccentric ring (7) and is connected with an upper end of the drilling bit shaft (5) via an inner eccentric ring bearing (32); wherein a near lower end of the drilling bit shaft (5) is connected with the universal joint (38), and a lower end of the drilling bit shaft (5) is connected with a drilling bit (1); wherein central axes of outer eccentric ring (7) hollow body and inner eccentric ring (31) hollow body form certain angles with eccentric rings respectively; wherein the outer eccentric ring (7) is a hollow cylinder with an eccentric hole, and the end of the outer eccentric ring connected with the stabilized platform body (10) is provided with a bearing mounting groove; wherein the drilling bit shaft (5) is a hollow cone, and the diameter of the lower end of the drilling bit shaft is larger than that of the upper end; wherein an outer cylindrical surface of the inner eccentric ring (31) is provided with six convex arced necks with screw holes; wherein an inner cylindrical surface of the outer eccentric ring (7) is provided with six concave arced necks same in diameter, and the convex arced necks are matched with the concave arced necks; wherein a bottom end of each concave arced neck is provided with a screw with a thread, and a bottom surface of the inner eccentric hole of the outer eccentric ring (7) is provided with eight screw holes used for connecting the stabilized platform body (10); and wherein the inner eccentric ring (31) and the outer eccentric ring (7) are fastened through screws.

9. The dynamic point-the-bit rotary steerable drilling tool of claim 1, further comprising an inner feedback control loop, an outer feedback control loop and a feedforward control loop; wherein the inner feedback control loop is an absolute speed control ring of the stabilized platform assembly (37); wherein the absolute speed controller adjusts motor speed to control absolute speed of the stabilized platform assembly (37); wherein the outer feedback control loop is a toolface angle control loop; wherein the toolface angle controller adjusts absolute speed set value to change toolface angle of the rotary steerable drilling tool; wherein the feedforward controller outputs compensation values of the motor speed by calculating measured values of a MEMS rate gyroscope in the instrument storehouse (20); and wherein the compensation values are used for eliminating absolute speed fluctuation of the stabilized platform assembly (37) caused by changes of revolving speed of the rotary housing (19).

10. A measure-control method adopting the dynamic point-the-bit rotary steerable drilling tool of claim 1, wherein said method comprises setting absolute speed set value $n_4$ of the absolute speed controller according to difference between a toolface angle set value and a toolface angle of the dynamic point-the-bit rotary steerable drilling tool of the attitude sensor (30) by a toolface angle controller; setting motor speed $n_6$ according to difference between the absolute speed set value $n_4$ and an absolute speed $\Delta n$ of the stabilized platform assembly (37) by the absolute speed controller; outputting a motor speed compensation value $n_5$ according to revolving speed $n_2$ of the rotary housing by the feedforward controller, and obtaining a motor driver set value $n_7$ by compensation value $n_5$ plus the motor speed $n_6$.

* * * * *